US012471708B2

(12) United States Patent
Allison

(10) Patent No.: US 12,471,708 B2
(45) Date of Patent: Nov. 18, 2025

(54) RECLINABLE SEATING APPARATUS

(71) Applicant: Humanscale Corporation, New York, NY (US)

(72) Inventor: Greg Allison, Allentown, PA (US)

(73) Assignee: Humanscale Corporation, New York, NY (US)

( * ) Notice: Subject to any disclaimer, the term of this patent is extended or adjusted under 35 U.S.C. 154(b) by 236 days.

(21) Appl. No.: 18/265,608

(22) PCT Filed: Dec. 8, 2021

(86) PCT No.: PCT/US2021/062404

§ 371 (c)(1),
(2) Date: Jun. 6, 2023

(87) PCT Pub. No.: WO2022/125662

PCT Pub. Date: Jun. 16, 2022

(65) Prior Publication Data

US 2024/0023712 A1 Jan. 25, 2024

Related U.S. Application Data

(60) Provisional application No. 63/122,890, filed on Dec. 8, 2020.

(51) Int. Cl.
*A47C 1/024* (2006.01)
*A47C 1/032* (2006.01)

(52) U.S. Cl.
CPC ..... *A47C 1/024* (2013.01); *A47C 1/032* (2013.01)

(58) Field of Classification Search
CPC ..... A47C 1/032; A47C 1/024
(Continued)

(56) References Cited

U.S. PATENT DOCUMENTS 3,572,829 A * 3/1971 Malitte ..... B64D 11/06 297/317
5,024,484 A * 6/1991 Buchacz ..... A47C 1/0244 297/325 X (Continued)

FOREIGN PATENT DOCUMENTS

KR 100968547 B1 7/2010
WO 2008020824 A2 2/2008
WO WO-2015167205 A1 * 11/2015 ..... A47C 1/024

OTHER PUBLICATIONS

EPO as Search Authority, PCT/US2021/062404, Search Report and Written Opinion dated May 16, 2022, 22 pages.

*Primary Examiner* — Rodney B White
(74) *Attorney, Agent, or Firm* — Jones Walker LLP

(57) ABSTRACT

A weight-sensitive, reclinable seating apparatus that features a backrest pivot mechanism positioned entirely within the seat assembly (200) of the seating apparatus. The backrest pivot mechanism comprises a plurality of ramp assemblages positioned within the seat assembly (200), with the ramp assemblages each comprising one or more motion-facilitating components (272*a*, 272*b*, 222*a*, 222*b*, 252*a*, 252*b*) that engage one or more ramps (215*a*, 215*b*, 255*a*, 255*b*, 217*a*, 217*b*). The motion-facilitating components (272*a*, 272, 222*a*, 222*b*, 252*a*, 252*b*) cooperate with the ramps (215*a*, 215*b*, 255*a*, 255*b*, 217*a*, 217*b*) to provide a virtual pivot (400) for the backrest (317) that is projected above the seat surface. The backrest pivot mechanism minimizes the vertical drop of the backrest during the recline motion, which in turn minimizes the seat lift during the recline motion. By minimizing the magnitude of the backrest drop and the seat lift during a recline operation, the seating apparatus reduces the displacement of the functional pivot from the ideal pivot point as the chair reclines.

17 Claims, 11 Drawing Sheets

(58) Field of Classification Search
USPC ..... 297/317, 318, 322, 325, 340, 341, 342
See application file for complete search history.

(56) References Cited

U.S. PATENT DOCUMENTS

| | | | | | |
|---|---|---|---|---|---|
| 5,261,723 | A * | 11/1993 | Hosoe | A47C 9/005 | 297/322 X |
| 5,333,368 | A * | 8/1994 | Kriener | A47C 7/444 | 297/303.3 |
| 5,603,551 | A * | 2/1997 | Sheehan | A47C 3/0257 | 297/322 X |
| 5,785,384 | A | 7/1998 | Sagstuen | | |
| 5,967,609 | A * | 10/1999 | Potter | A47C 3/03 | 297/325 X |
| 6,012,774 | A * | 1/2000 | Potter | A47C 3/0257 | 297/325 X |
| 6,106,065 | A * | 8/2000 | Carroll | A47C 1/0347 | 297/325 |
| 6,382,725 | B1 * | 5/2002 | Carroll | A61G 15/02 | 297/325 |
| 6,641,214 | B2 * | 11/2003 | Veneruso | B60N 2/02246 | 297/317 X |
| 6,945,602 | B2 * | 9/2005 | Fookes | A47C 1/03261 | 297/300.4 |
| 7,090,240 | B2 * | 8/2006 | Papac | A61G 5/12 | 297/325 X |
| 8,662,586 | B2 * | 3/2014 | Serber | A47C 3/0257 | 297/318 X |
| 9,364,091 | B2 * | 6/2016 | Costaglia | A47C 1/03294 | |
| 9,462,889 | B2 * | 10/2016 | Piretti | A47C 1/03255 | |
| 11,969,094 | B2 * | 4/2024 | Schmitz | A47C 3/12 | |
| 12,193,572 | B2 * | 1/2025 | Robertson | A47C 17/1756 | |
| 2014/0028068 | A1 * | 1/2014 | Birkbeck | A47C 1/022 | 297/340 |

* cited by examiner

RECLINABLE SEATING APPARATUS

CROSS REFERENCE TO RELATED APPLICATIONS

This application is a national stage application under 35 USC § 371 of PCT/US2021/062404, filed on Dec. 8, 2021, which claims the benefit of U.S. Provisional Ser. No. 63/122,890 filed on Dec. 8, 2020, each of which is hereby incorporated by reference in its entirety.

FIELD OF THE INVENTION

The invention relates to a reclinable seating apparatus for supporting an occupant in a seated position.

BACKGROUND

A common goal in the field of seating apparatuses, particularly office chairs and the like, is to improve the comfort and fit for the occupant. Reclinability is a key feature for providing a chair that can be utilized for an entire workday without discomfort. There have been a variety of approaches employed in order to provide reclinability.

Conventional reclining chairs utilize one or more springs to bias the backrest in the upright position and provide resistance to the reclining motion. Springs, by their very nature, exhibit a linear increase in the output force as the spring is deformed. Thus, because a spring can only provide a singular recline curve across its range of motion, designers of conventional reclining chairs typically select a spring that accommodates the size and weight of the median occupant. At the extremes of the population, the recline resistance force provided by the spring will not match the force being applied by the occupant during the reclining motion, thus preventing the occupant from comfortably utilizing the recline mechanism. Large occupants will find the resistance force to be too weak and thus find the reclinable chair too prone to recline. Conversely, small occupants will find the resistance force to be too strong and thus have difficulty utilizing the recline mechanism at all.

Weight-sensitive reclinable chairs have been developed in order to address the shortcomings of conventional reclining chairs. Weight-sensitive reclining chairs feature recline mechanisms that cause the seat to rise against the weight of the occupant as the backrest is reclined. In this manner, the occupant's own weight provides at least a portion of the recline-resistance force, thereby customizing the counterbalancing force provided by the chair's recline mechanism to the occupant. Many commercially-available weight-sensitive reclinable chairs utilize a combination of the occupant's weight and one or more conventional springs to provide the overall recline-resistance force.

Weight-sensitive reclinable chairs aim to provide a chair whose recline action parallels the natural body action during recline. However, with many weight-sensitive reclinable chairs, there is a tendency for the occupant's legs to be lifted from the floor during recline, thereby causing the underside of the occupant's legs to be supported solely by the forward edge of the seat. This phenomenon creates a pressure point for the occupant's legs that can cause discomfort. To overcome this problem, the pivot point of the reclining mechanism may be moved forward (i.e., towards the front edge of the seat) to reduce the front seat lift at full recline sufficiently to permit the occupant's feet to stay on the floor. The undesirable effect of this arrangement is that the body angle between the occupant's torso and legs is unchanged and as a result, the occupant's eye level drops undesirably when the chair is reclined. Moreover, if you move the pivot point too far forward, the center of gravity of the occupant's back tends to fall too much during reclining actions, making it difficult for the occupant's weight to counterbalance the reclining force.

For the foregoing reasons, weight-sensitive reclinable chairs typically have their backrest pivotally attached to the seat at a position below the seat and proximate to the user's hip joints. However, when the backrest pivot is located in this position, the pivot point is displaced from its ideal position during reclining actions. An improved weight-sensitive reclinable chair is needed that maintains the most ergonomic relationship as possible between the seat and the backrest throughout its range of motion.

BRIEF DESCRIPTION OF THE DRAWINGS

The accompanying figures, together with the detailed description below, are incorporated in and form part of the specification, serve to illustrate further various exemplary embodiments and to explain various principles and advantages in accordance with the present invention.

DETAILED DESCRIPTION

Figure 1:
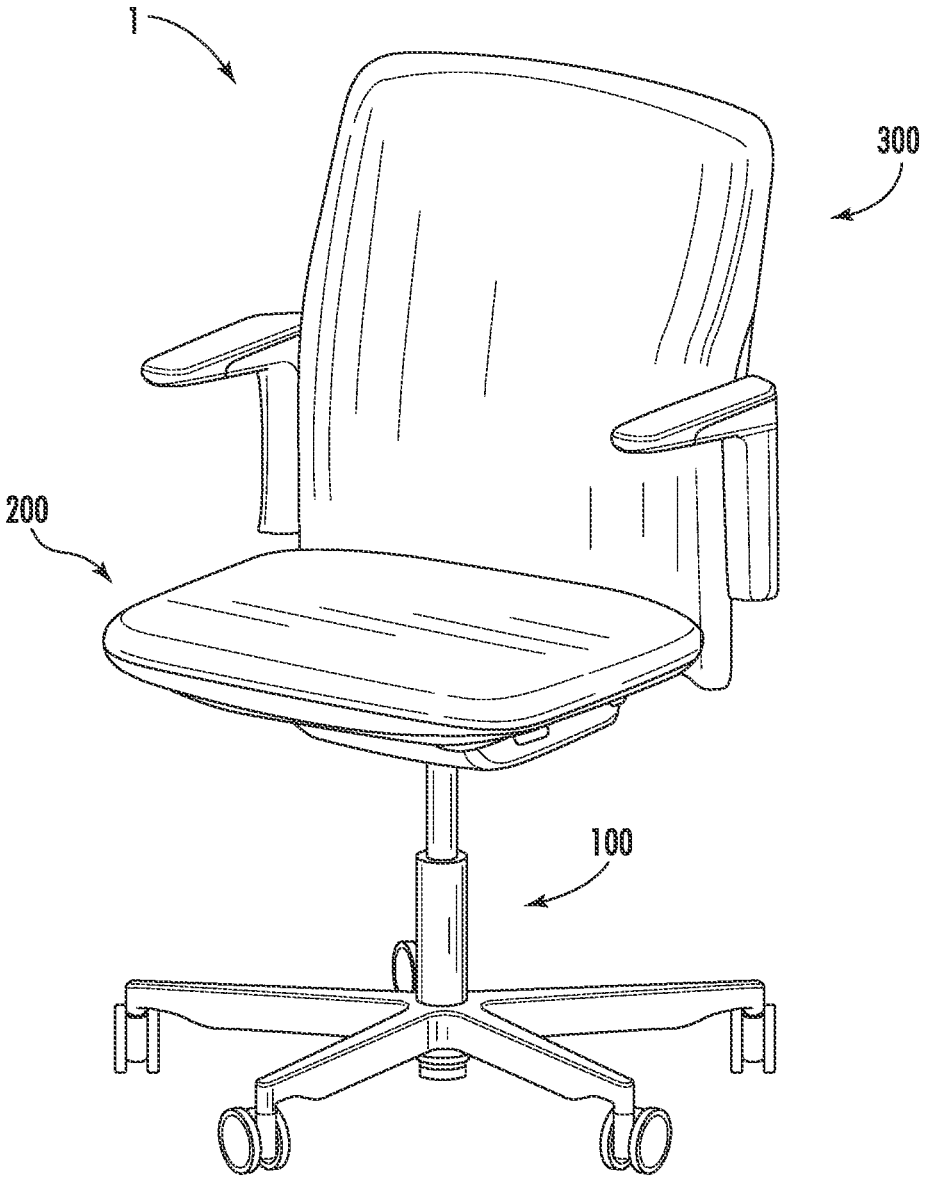
FIG. 1 is a perspective view of an embodiment of a chair employing features of the present invention.

Detailed embodiments of the present invention are disclosed herein. However, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Alternate embodiments may be devised without departing from the spirit or the scope of the invention. Further, the terms and phrases used herein are not intended to be limiting, but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward.

Figure 18A:
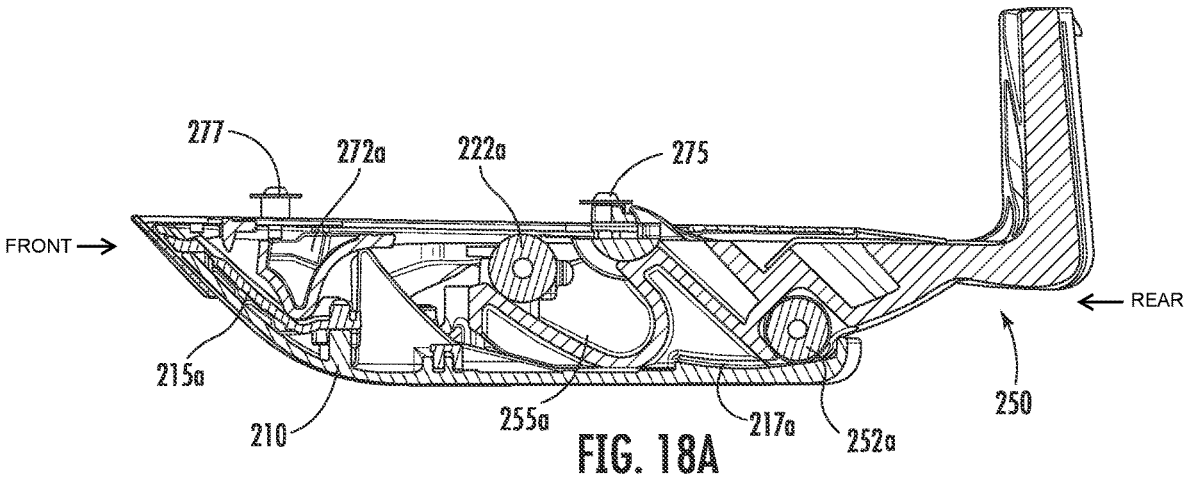
FIG. 18A is a right-side sectional view of the chair depicted in FIG. 1 in the upright state.

As used herein, the terms "a" or "an" are defined as one or more than one. The term "plurality," as used herein, is defined as two or more than two. The term "another," as used herein, is defined as at least a second or more. The terms "comprises," "comprising," or any other variation thereof are intended to cover a non-exclusive inclusion, such that a process, method, article, or apparatus that comprises a list of elements does not include only those elements, but may include other elements not expressly listed or inherent to such process, method, article, or apparatus. An element proceeded by "comprises . . . a" does not, without more constraints, preclude the existence of additional identical elements in the process, method, article, or apparatus that comprises the element. The terms "including," "having," or "featuring," as used herein, are defined as being synonymous with the term "comprising" (i.e., open language). The term "coupled," as used herein, is defined as connected, although not necessarily directly, and not necessarily mechanically. As used herein, the term "about" or "approximately" applies to all numeric values, whether or not explicitly indicated. These terms generally refer to a range of numbers that one of skill in the art would consider equivalent to the recited values (i.e., having the same function or result). The terms "motion-facilitating component(s)" and "roller(s)" are used synonymously herein and should be understood to encompass any motion-facilitating component, such as rollers, glides, wheels, spherical balls, or any other structure capable of engaging with an adjacent surface and moving forwards and rearwards along the surface. For the sake of simplicity, the motion-facilitating components may be referred to herein only in terms of rollers unless otherwise specified. The terms "front", "rear," "side", "forwardly", "rearwardly", "upwardly" and "downwardly" as used herein are intended to indicate the various directions and portions of the chair as normally understood when viewed from the perspective of a user sitting in the chair. The terms "longitudinal" and "lateral" as used herein are intended to indicate the direction of the chair from front to rear and from side to side, respectively. For the avoidance of doubt, the "rear" or "rear portion" of the seat assembly should be understood to refer to the area of the chair's seat assembly proximate to the backrest as indicated in FIG. 18A. The "front" or "front portion" of the seat assembly should be understood to refer of the area of the chair's seat assembly proximate to a user's knee joints when seated on the seating apparatus as indicated in FIG. 18A.

The present invention is directed to a weight-sensitive, reclinable seating apparatus that features a backrest pivot mechanism capable of providing a virtual pivot for the backrest that is projected above the seat surface. In preferred embodiments, the backrest pivot mechanism is positioned entirely within the seat assembly of the seating apparatus and is designed to minimize the vertical drop of the backrest during the recline motion, which in turn minimizes the seat lift during the recline motion. By minimizing the magnitude of the backrest drop and the seat lift during a recline operation, the seating apparatus of the present invention reduces the displacement of the functional pivot from the ideal pivot point as the chair reclines. Ideally, to maintain the most ergonomic relationship as possible between the seat and the backrest during reclining actions, the virtual backrest pivot should be located just behind and just below the center of an occupant's lumbar region. However, when located at this position, an occupant experiences a sensation of the backrest pivoting around their lumbar region as opposed to a natural recline sensation. Thus, in order for the occupant to experience a suitable recline sensation, the virtual pivot must be projected above the seat surface at a position between the occupant's hip joint and the occupant's lumber region. If the virtual pivot is projected to far above the seat surface, the occupant will experience a sensation of the backrest pivoting around their back. If the virtual pivot is projected too far forward, it will cause the center of gravity of the occupant's back to fall too much during reclining actions and therefore make it difficult for the occupant's weight to counterbalance the reclining force. In a particular preferred embodiment, the virtual pivot is projected 120 mm+20 mm above the seat surface and 20 mm+20 mm forward of the backrest, which is approximately 50-70 mm above and 60-80 mm behind the median user's hip joint (which itself is generally located approximately 40-60 mm above the seat surface and approximately 100 mm forward of the backrest) when the median user is seated in the chair in the upright position. Most preferably, the virtual pivot is projected 120 mm above the seat surface and 35 mm forward of the backrest. The seating apparatus preferably exhibits a front seat lift of approximately 1"±0.25" and a rearward seat pitch of approximately 1-3 degrees between the upright position and the fully reclined position.

In embodiments exemplifying the principles of the present invention, the backrest pivot mechanism comprises a plurality of motion-facilitating components and corresponding ramps positioned within the seat assembly for providing the virtual pivot for the seating apparatus' backrest assembly. The seating apparatus beneficially takes advantage of the weight of the user to facilitate both a reclining motion and a seat lifting motion, as well as to provide for ease of return to the upright, seat lowered position. The interaction of the motion facilitating components and ramps dictate the rearward motion of the backrest and the upward motion of the seat during recline. The combination of the recline geometry with the shape and angle of the ramps is preferably calculated to cause the seated weight of the occupant to be transferred proportionally as a counter-balance to the recline force. As a seated user leans backward in the chair to recline, the load from the user's body weight transitions from being almost exclusively supported by the seat to being at least partially supported by the backrest. Thus, as the angle of the recline increases, the load (i.e., the force) being applied against the backrest increases. Accordingly, in preferred embodiments of the invention, the ramps are beneficially designed such that the gradient or incline of the ramps (referred to herein as the "ramp angle") changes as the reclining action of the chair increases to account for the increasing load exerted by the occupant's upper body as the backrest is reclined. By varying the ramp angle across the ramp's length, the seating apparatus can be optimized to offset and counterbalance the increasing force being applied to the backrest during recline so that the seating apparatus reclines in a controlled fashion. Moreover, the combination of the recline geometry with the shape and angle of the ramps is also preferably calculated to minimize the vertical drop of the backrest during the recline motion, which in turn minimizes the seat lift during the recline motion.

Figure 2:
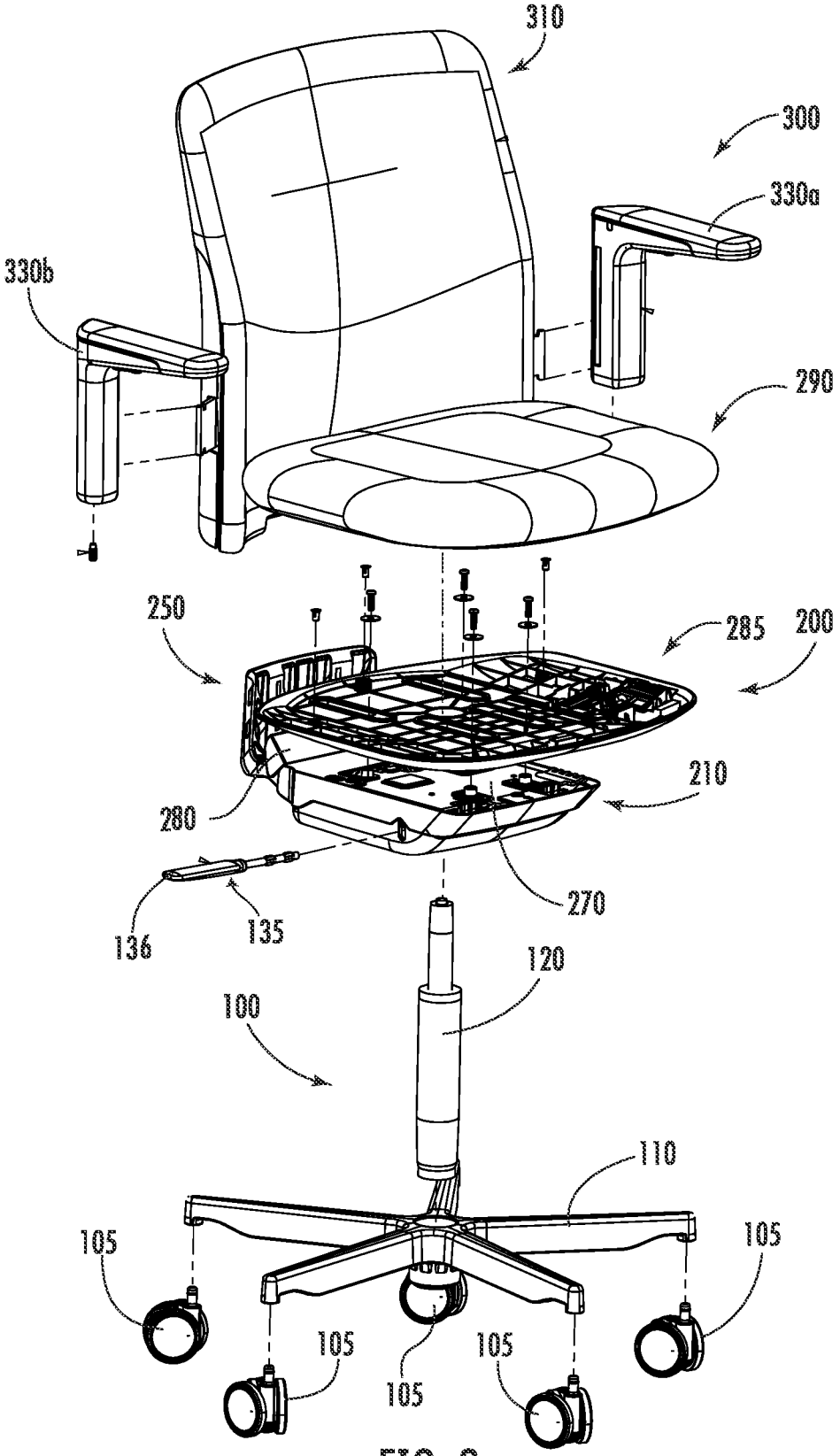
FIG. 2 is a partially exploded view of the chair depicted in FIG. 1.
Figure 3:
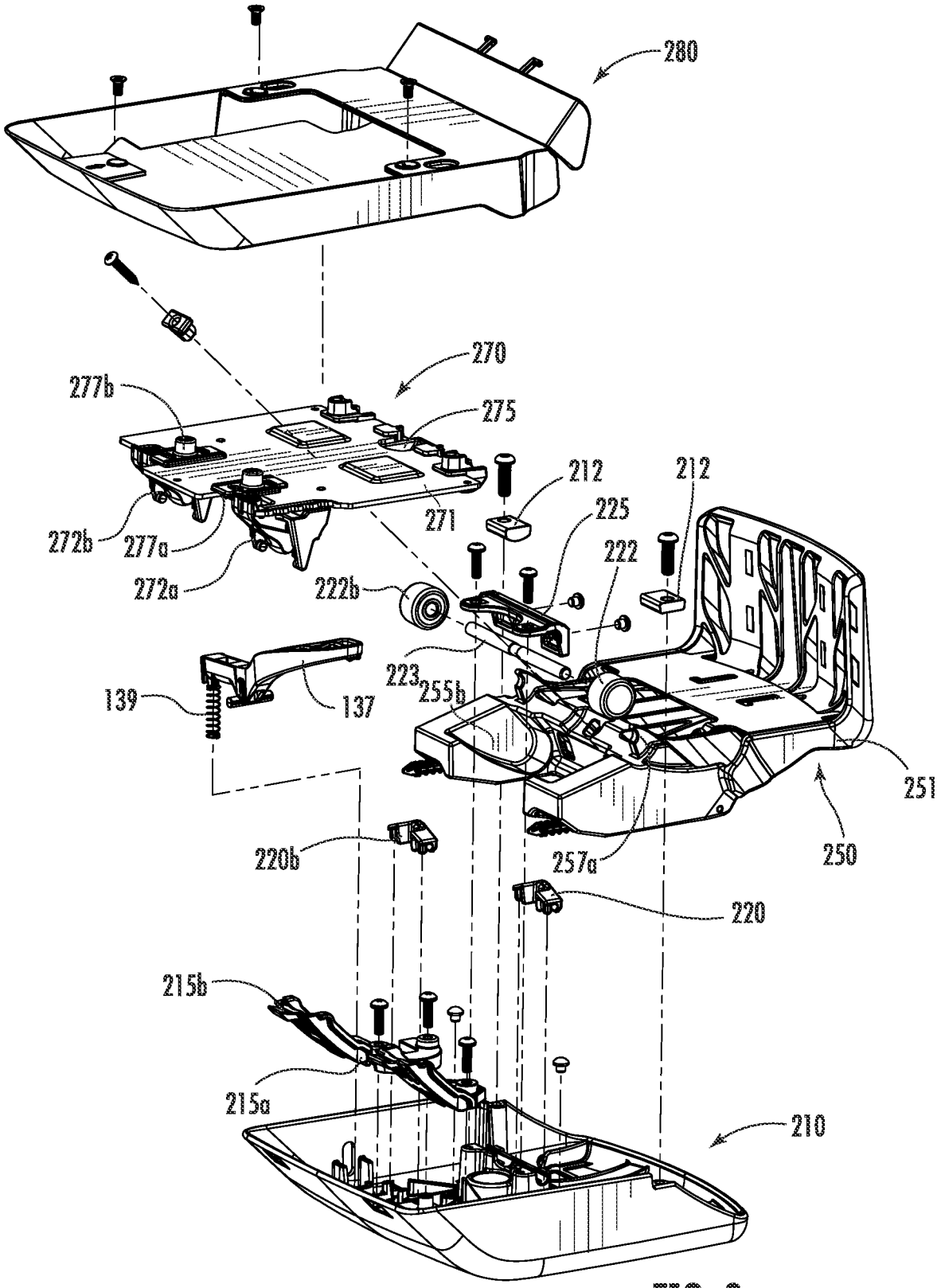
FIG. 3 is an exploded view of the seat assembly of the chair depicted in FIG. 1.
Figure 5:
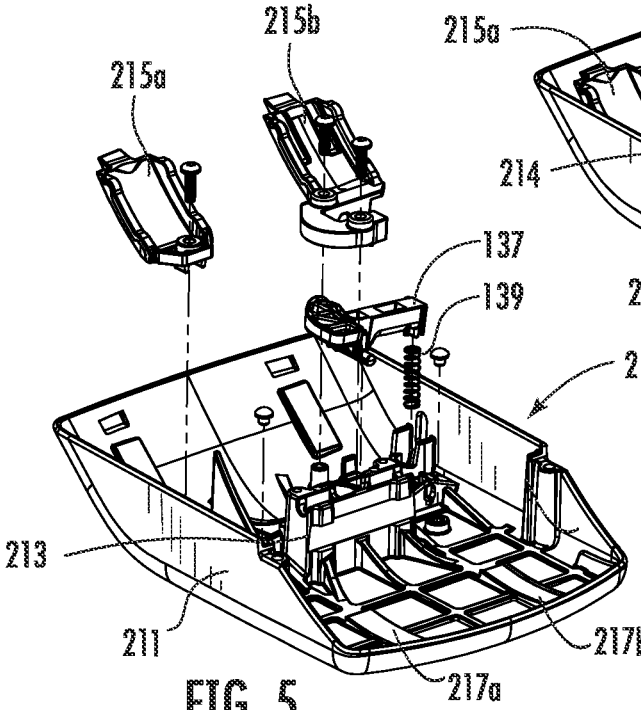
FIG. 5 is a partially exploded view of the housing subassembly of the chair depicted in FIG. 1.
Figure 4:
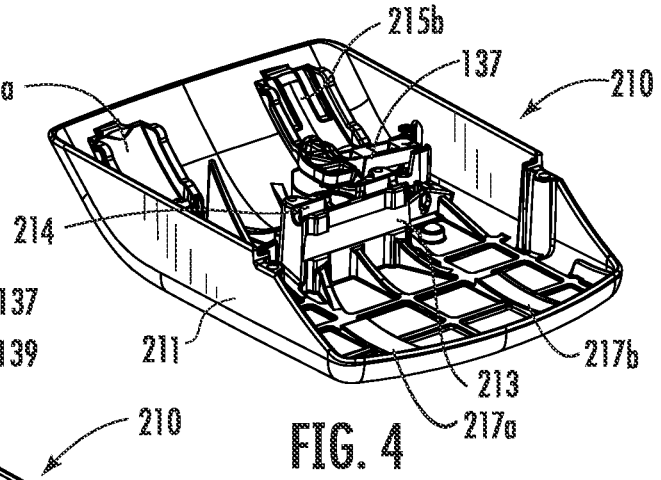
FIG. 4 is a rear perspective view of the housing subassembly of the chair depicted in FIG. 1.
Figure 6:
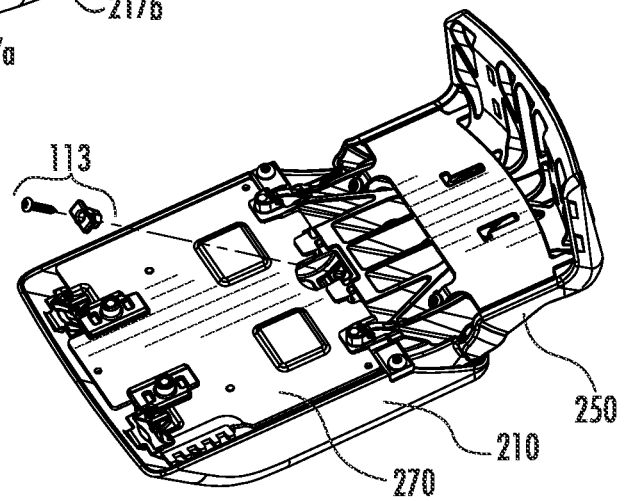
FIG. 6 is a top perspective view of the seat assembly of the chair depicted in FIG. 1 with the shroud and seat removed.
Figure 7:
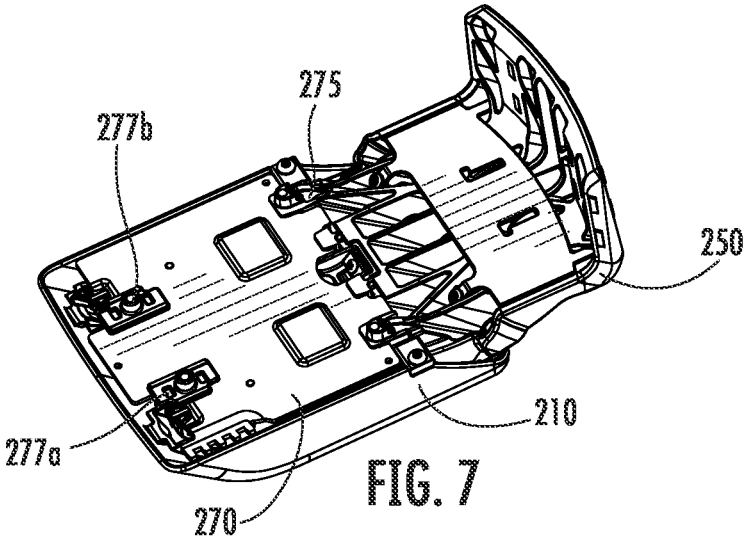
FIG. 7 is another top perspective view of the seat assembly of the chair depicted in FIG. 1 with the shroud and seat removed.
Figure 8:
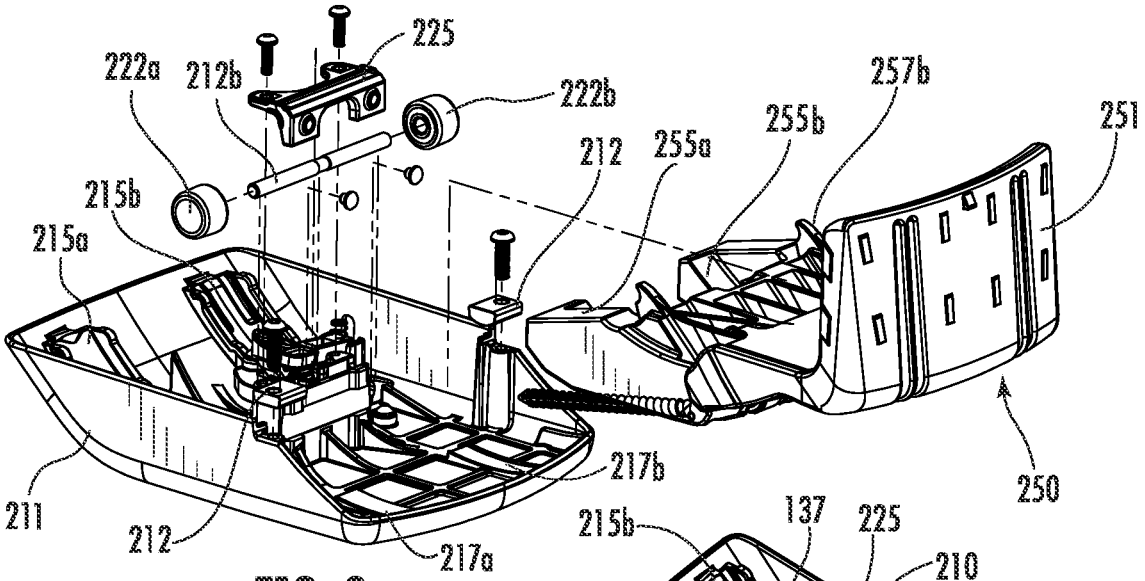
FIG. 8 is a partially exploded, rear perspective view of the housing and connector subassemblies of the chair depicted in FIG. 1.
Figure 9:
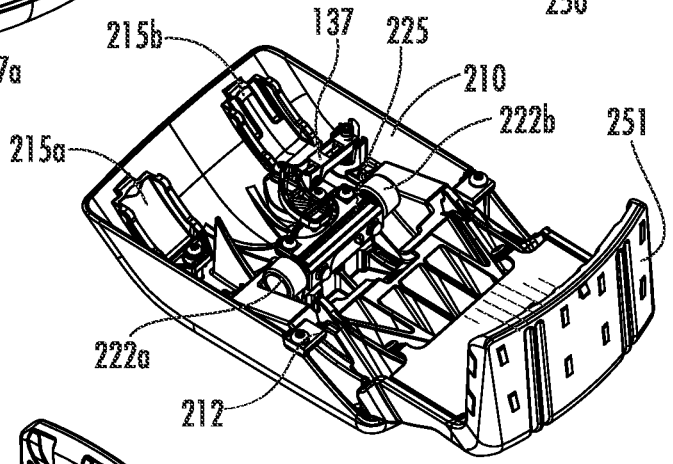
FIG. 9 is a rear perspective view of the housing and connector subassemblies of the chair depicted in FIG. 1.
Figure 10:
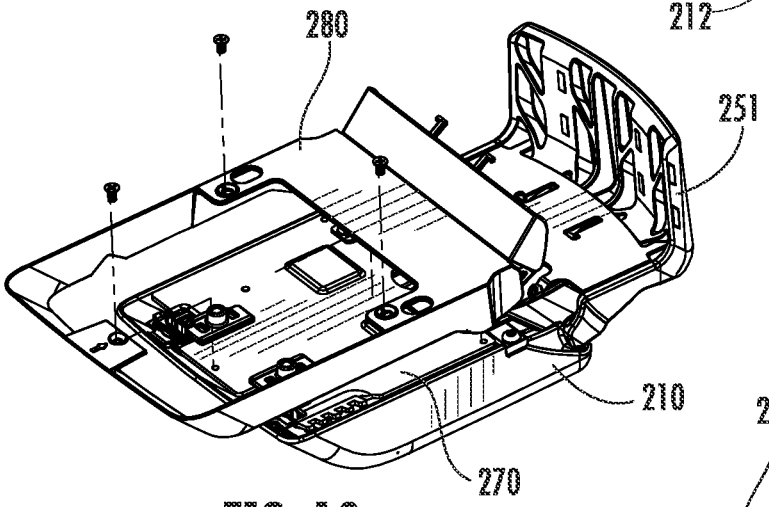
FIG. 10 is a partially exploded, top perspective view of the seat assembly of the chair depicted in FIG. 1 with the shroud shown partially removed.
Figure 11:
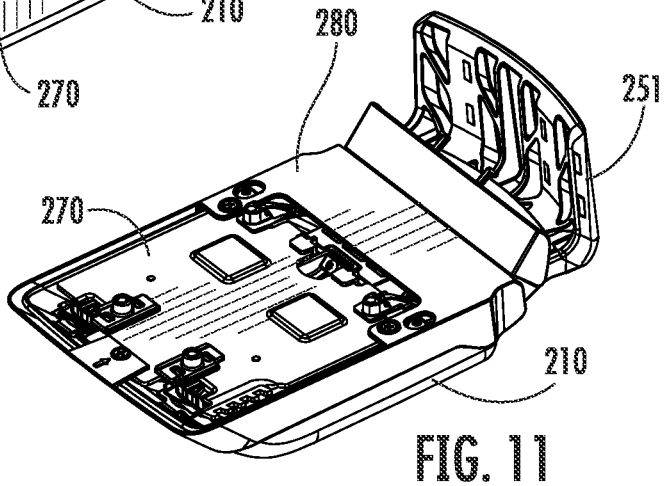
FIG. 11 is another top perspective view of the seat assembly of the chair depicted in FIG. 1 with the seat removed.
Figure 12:
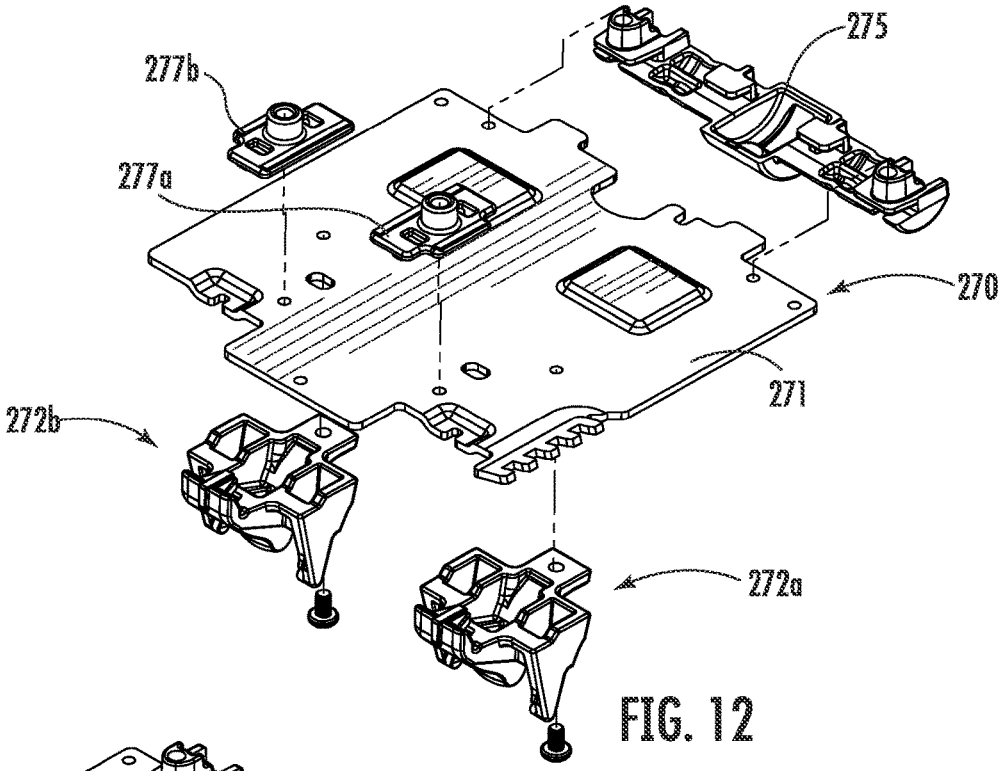
FIG. 12 is a partially exploded, top perspective view of the seat plate subassembly of the chair depicted in FIG. 1.
Figure 13:
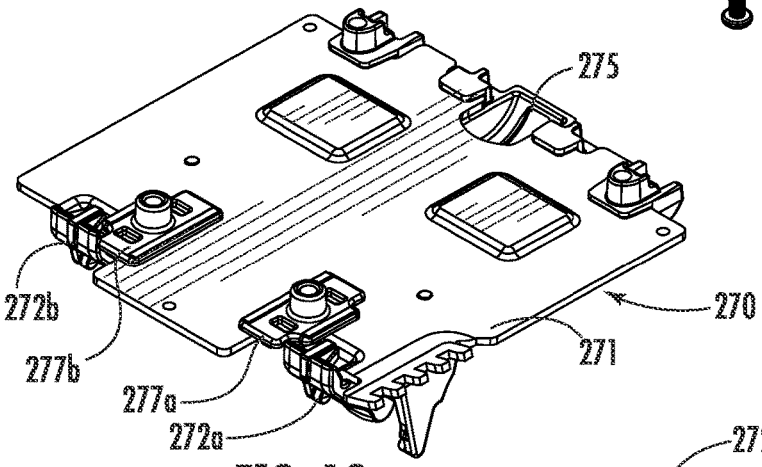
FIG. 13 is a top perspective view of the seat plate subassembly of the chair depicted in FIG. 1.
Figure 14:
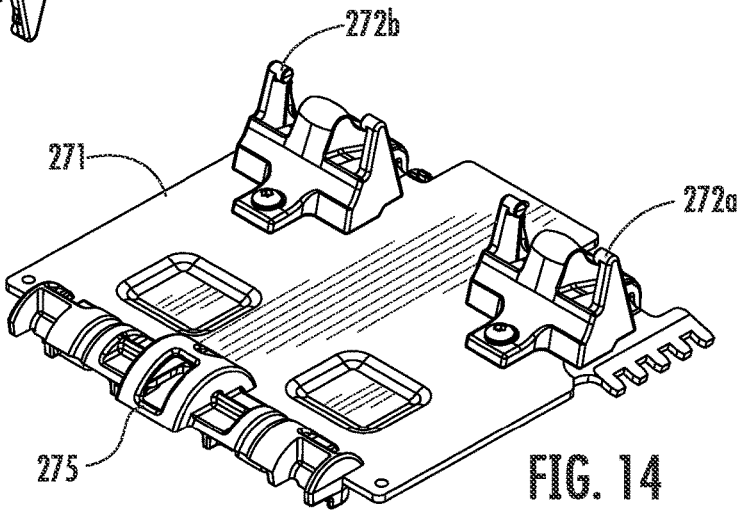
FIG. 14 is a bottom perspective view of the seat plate subassembly of the chair depicted in FIG. 1.
Figure 15:
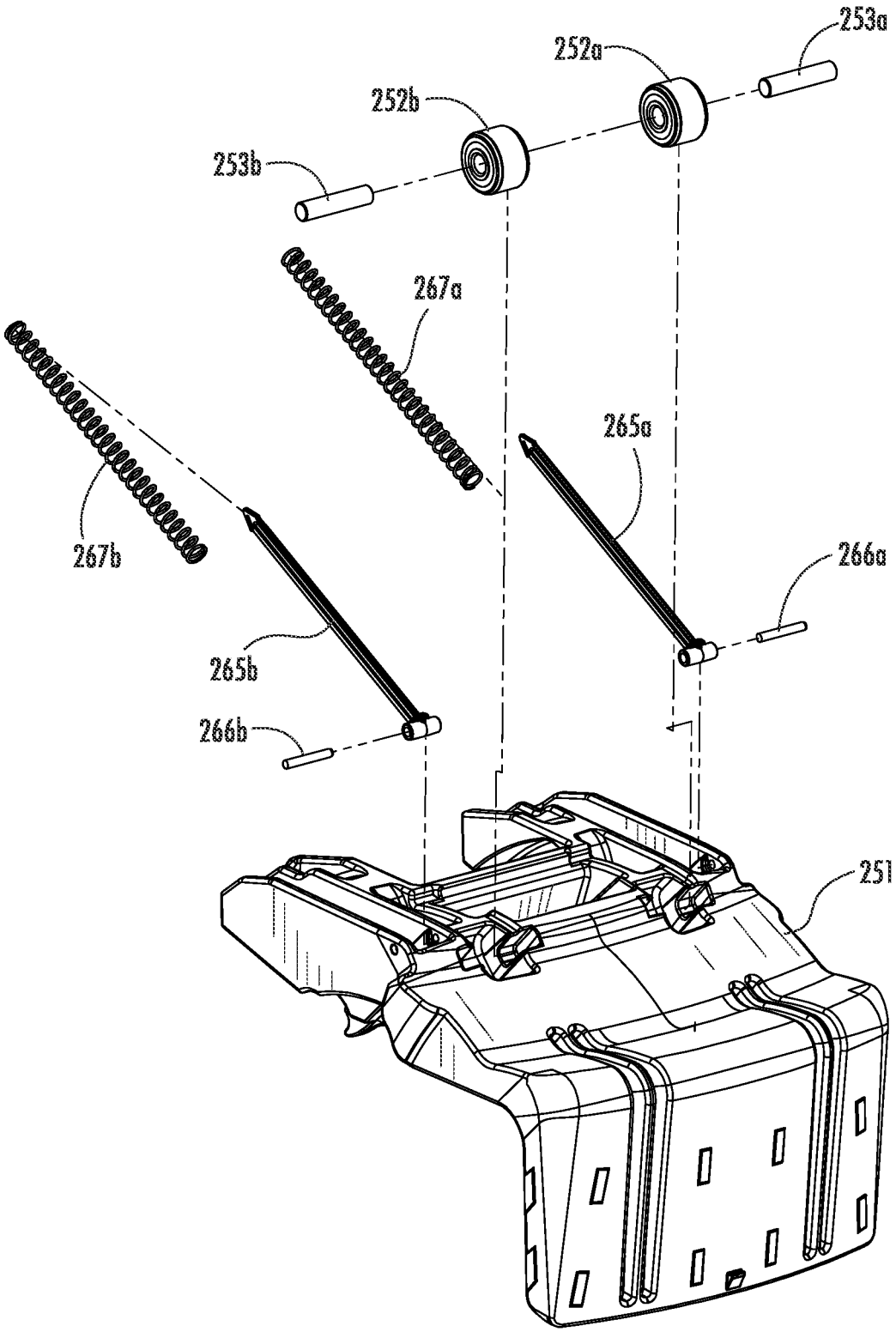
FIG. 15 is an exploded, bottom perspective view of the connector subassembly of the chair depicted in FIG. 1.
Figure 16:
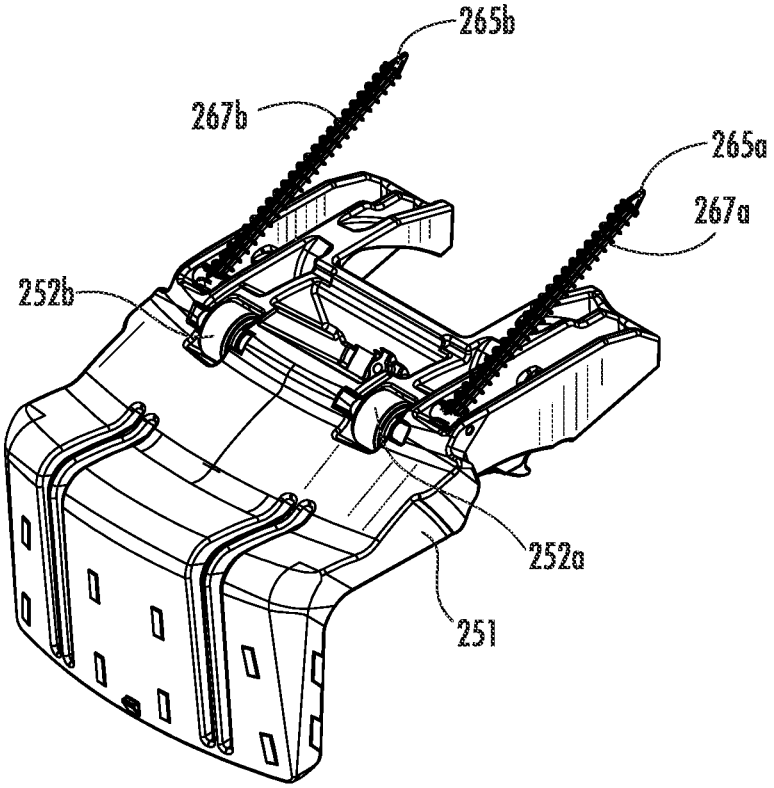
FIG. 16 is a bottom perspective view of the connector subassembly of the chair depicted in FIG. 1.
Figure 17:
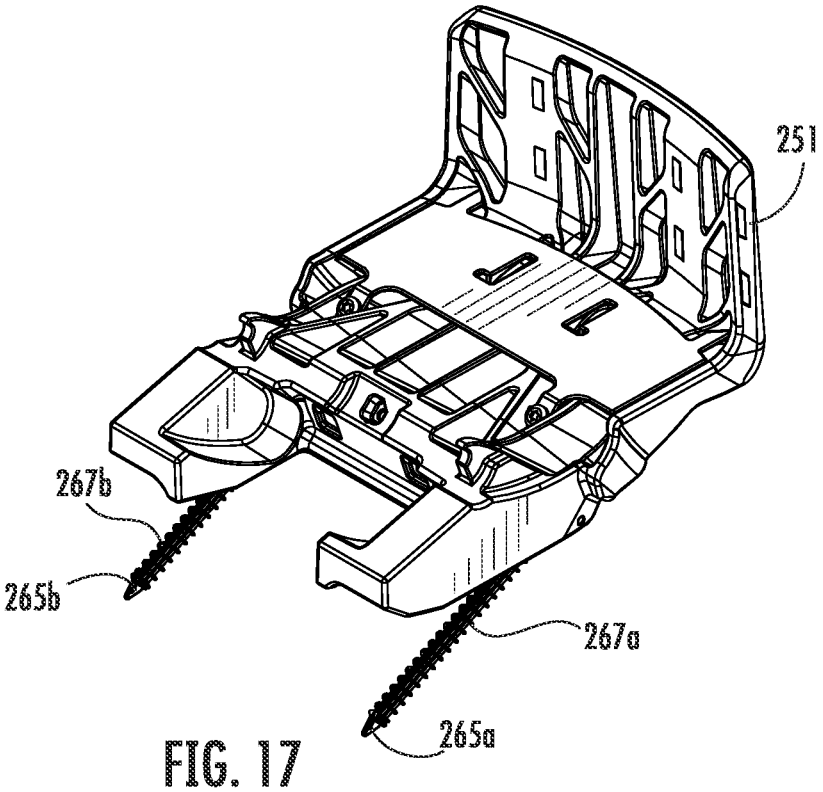
FIG. 17 is a top perspective view of the connector subassembly of the chair depicted in FIG. 1.

Referring now to FIGS. 1-2, an exemplary embodiment of a seating apparatus 1 (e.g., an office chair) embodying features of the present invention is depicted. The chair 1 comprises a base assembly 100, a seat assembly 200, and a backrest assembly 300. The seat assembly 200 is mounted to the base assembly 100, while the backrest assembly 300 is mounted to the seat assembly 200.

The base assembly 100 may comprise any base known in the art for supporting a seat at a sufficient height for a user. In the depicted embodiment, the base assembly 100 comprises a base 110, a plurality of casters 105, and a column 120. The base 110 comprises five legs with individual casters 105 pivotally attached to the distal end of each leg. The column 120 comprises a height-adjustable, gas cylinder attached to the center of the base 110 to provide a pedestal on to which the seat assembly 200 may be mounted. In alternative embodiments, other known base assemblies may be utilized. For example, the base assembly 100 of the chair 1 may comprise four legs, a swivel pedestal, a cantilever base, or other known base assemblies commonly used with a seating apparatus.

The seat assembly 200 may comprise a housing subassembly 210, a connector subassembly 250, a seat plate subassembly 270, a shroud 280, a seat casing 285, and a seat 290. The housing subassembly 210 may be mounted to the column 120 using a fastener or other known means in the art. A handle subassembly 135 may be attached to the housing subassembly 210 and operatively coupled to the column 120 to provide a means for adjusting the level of extension of the column 120 and, consequently, the height of the seat 290. The connector subassembly 250 depicted in FIGS. 1-2 comprises a generally L-shaped connector 251 and functions to connect the backrest 310 to the seat 290. In the depicted embodiment, the vertical extension of the connector 251 may be partially disposed within a cavity formed within the backrest 310, and the horizontal extension of the connector 251 may be partially disposed with the housing 210. The seat plate subassembly 270 may be pivotally connected to the connector 251, with an optional shroud 280 being positioned over the seat plate subassembly 270. The bottom of the seat casing 285 may be mounted to the seat plate subassembly 270, and the seat 290 may be mounted to the top of the seat casing 285. The connector subassembly 250, the housing subassembly 210 and the seat plate subassembly 270 function together to provide the pivot mechanism for the backrest assembly 300.

The backrest assembly 300 may comprise a backrest 310 and optional armrests 330*a*, 330*b* attached thereto. The backrest 310 may be operatively coupled to the vertical extension of the connector 251 such that when a rearward force is applied to the backrest, it is transferred to the connector 251. In certain embodiments, the backrest 310 is fixedly attached to the vertical extension of the connector 251 such that the backrest 310 does not pivot relative to the vertical extension of the connector 251. In alternative embodiments, the backrest 310 may be pivotally coupled to the vertical extension of the connector 251. The armrests 330*a*, 330*b* may be mounted to the left and right sides of the backrest 310, respectively.

Referring now to FIGS. 3-17, embodiments of the various components of the seat assembly 200 are depicted. The seat apparatus 1 features a backrest pivot mechanism comprising a connector 251 that interfaces with the seat assembly's housing 210 via a plurality of motion-facilitating components and corresponding ramps (each motion-facilitating component/ramp pairing referred to herein as a "ramp assemblage") positioned within the seat assembly 200 for providing a virtual pivot 400 for the backrest assembly 300. In the depicted embodiment, the backrest pivot mechanism comprises front, central and rear ramp assemblages, with the central and rear ramp assemblages operating in cooperation to provide the virtual pivot 400 for the backrest that is projected above the seat surface and forward of the backrest. The front ramp assemblage comprises right and left front glides 272*a*, 272*b* that engage right and left front housing ramps 215*a*, 215*b*. The central ramp assemblage comprises right and left central rollers 222*a*, 222*b* that engage arcuate connector ramps 255*a*, 255*b*. The rear ramp assemblage comprises right and left rear rollers 252*a*, 252*b* that engage right and left rear housing ramps 217*a*, 217*b*.

As shown in FIGS. 3-5 and 8-9, the housing subassembly 210 can comprise a housing 211, right and left front housing ramps 215*a*, 215*b* positioned in the front portion of the housing 211, right and left rear housing ramps 217*a*, 217*b* positioned in the rear portion of the housing 211, a central post 213 positioned in the central portion of the housing 211, and right and left central rollers 222*a*, 222*b* mounted to the central post 213. The housing 211 can take the form of a generally rectangular tub defined by a bottom floor, two substantially parallel sidewalls, and a sloping front wall. Right and left front housing ramps 215*a*, 215*b* may be mounted to the front of the housing 211 in a position adjacent to the sloping front wall, while right and left rear ramps 217*a*, 217*b* may be mounted to the rear portion of the bottom floor of the housing 211. In certain embodiments, the front and rear ramps 215*a*, 215*b*, 217*a*, 217*b* may be separate components attached to the housing 211 using one or more fasteners. In other embodiments, and particularly where the housing 211 is constructed from molded plastic, the front and rear ramps 215*a*, 215*b*, 217*a*, 217*b* may be integrally formed into the housing 211 during the molding process. In the particular embodiment depicted in Figure FIGS. 3-17, the front housing ramps 215*a*, 215*b* are separate components fixedly attached to the housing 211, while the rear housing ramps 217*a*, 217*b* are integrally formed into the housing 211.

Still referring to FIGS. 3-5 and 8-9, a central post 213 may be attached to, or integrally formed with, the bottom floor of the housing 211 at a position between the front and rear of the housing 211. The central axle 223 may be positioned in a channel seat 214 (see FIG. 4) formed in the central post 213, with the axle cap 225 positioned over the front axle 223 to hold the central axle 223 in the seat 214. Right and left central rollers 222*a*, 222*b* may be attached to the right and left ends, respectively, of the central axle 223. In alternative embodiments, the right and left central rollers 222*a*, 222*b* may take the form of other motion-facilitating components, such as glides, spherical balls, or any other structure capable of moving forwards and rearwards along the arcuate connector ramps 255*a*, 255*b*.

The handle subassembly 135 may be operatively coupled to the central post 213 to provide a means for adjusting the level of extension of the column 120 and, consequently, the height of the seat 290. The handle subassembly 135 may comprise a height adjustment pivot lever 137 pivotally mounted to the central post 213. The second end of the pivot lever 137 is operatively coupled to the upper end of the column 120 (e.g., a gas cylinder) to selectively adjust the extension of the column 120. A handle 136 can be attached to the first end of the pivot lever 137 and extend through an aperture in the housing 211 to allow the user to toggle the handle subassembly 135 and adjust the height of the chair 1. A spring 139 can be operatively coupled to the first end of the pivot lever 137 to bias the pivot lever 137 in a first direction. A column fastener 113 can be utilized to secure the top end of the column 120 to the housing 210 (see FIG. 6).

Referring now to FIGS. 3, 8-9, and 15-17, an embodiment of the connector subassembly 250 is depicted. The connector subassembly 250 may comprise a connector 251, arcuate connector ramps 255, and rear rollers 252*a*, 252*b*. As described above, the connector 251 may generally be L-shaped with a horizontal extension and a vertical extension. In a preferred embodiment, the L-shaped connector is a rigid member that is substantially non-deformable under forces typically encountered during the seating apparatus' use (i.e., <400 lbs). Arcuate connector ramps 255*a*, 255*b* may be attached to, or integrally formed in, the front end of the horizontal extension of the connector 251. The right and left rear rollers 252*a*, 252*b* may be rotatably coupled to the bottom of the connector 251. In the depicted embodiment, the right and left rear rollers 252*a*, 252*b* are positioned in slots formed in the bottom portion of the connector 251 proximate to the rear end of the horizontal extension. The right and left rear axles 253*a*, 253*b* extend through the right and left rear rollers 252*a*, 252*b*, respectively, to rotatably mount the rollers to the connector 251. The connector subassembly 250 is operatively coupled to the housing subassembly 210 by seating the right and left central rollers 222*a*, 222*b* of the housing subassembly within the right and left connector ramps 255*a*, 255*b*, respectively, of the connector subassembly 250. Meanwhile, the right and left rear rollers 252*a*, 252*b* of the connector subassembly 250 will engage the right and left rear ramps 217*a*, 217*b*, respectively, of the housing subassembly 210. Right and left connector retainers 212 may be utilized to assist with maintaining the coupling between connector 251 and the housing subassembly 210.

In certain embodiments, one or more springs optionally may be attached between the connector 251 and the housing 211 to bias the seating apparatus in the upright position when the chair is unoccupied. Preferably, the seating apparatus does not rely on a spring to increase or decrease the reclining counterbalance force. Instead, the spring merely provides a secondary force to overcome the weight of the chair components and maintain an unoccupied chair in an upright position. In the depicted embodiment, right and left spring assemblies are utilized and provide approximately 8 lbs of recline force at the center of gravity of the occupant's back at full recline. The right spring subassembly comprises a spring piston 265*a* extending through a helical spring 267*a*. Similarly, the left spring subassembly comprises a spring piston 265*b* extending through a helical spring 267*b*. The right and left spring pistons 265*a*, 265*b* each are pivotally attached to the base of the connector 250 via right and left pivot rods 266*a*, 266*b*. Meanwhile, right and left spring retainers 220*a*, 220*b* may be attached to the bottom floor for coupling the distal ends of the right and left pivot rods 266*a*, 266*b* to the housing 210.

Referring now to FIGS. 3, 6-7, and 12-14, an embodiment of the seat plate subassembly 270 is depicted. The seat plate subassembly 270 may comprise a seat plate 271, a seat pivot 275, right and left front glides 272*a*, 272*b*, and right and left seat slide bearings 277*a*, 277*b*. The seat pivot 275 functions to provide a means for pivotally connecting the seat pivot 275 to the connector 251. The seat pivot 275 may be attached to the rear portion of the seat plate 271 at a first position and pivotally attached to right and left finger extensions 257*a*, 257*b* of the connector 251 at a second position. Right and left front glide members 272*a*, 272*b* may be attached to the front portion of the seat plate 271 and generally extend downward from the seat plate 271 such that the right and left front glides 272*a*, 272*b* engage the right and left front ramps 215*a*, 215*b*, respectively, of the housing subassembly 210. In alternative embodiments, the right and left front glides 272*a*, 272*b* may take the form of other motion-facilitating components, such as rollers, spherical balls, or any other structure capable of moving forwards and rearwards along the ramps. Right and left seat slide bearings 277*a*, 277*b* may be attached to the top of the seat plate 271. The seat casing 285 may be mounted to seat plate 271 by attachment to the slide bearings 277*a*, 277*b*, with the seat 290 attached to the seat casing 285.

Referring now to FIGS. 18-19, section views of the chair 1 are depicted in both the upright and reclined states, showing the interaction of the connector subassembly 250, housing subassembly 110, and seat plate subassembly 270 to provide the recline mechanism of the present invention.

In the upright state depicted in FIG. 18A, the seat plate subassembly 270 (and therefore the attached seat 290) is in a position generally parallel to the bottom floor of the housing 211, while the vertical extension of the connector 251 (and therefore the attached backrest 310) is in a position generally perpendicular to the seat plate subassembly 270 and the bottom floor of the housing 211. In the upright state, the front, central and rear ramp assemblies are in the following states: the right and left front glides 272*a*, 272*b* are positioned at the rear (or bottom) portions of the right and left front housing ramps 215*a*, 215*b*; the central rollers 222*a*, 222*b* are positioned on the front portions of the right and left arcuate connector ramps 255*a*, 255*b*, respectively; and the rear rollers 252*a*, 252*b* are positioned on the rear portions of the right and left rear housing ramps 217*a*, 217*b*, respectively. In the upright state, the seat pivot 275 is positioned rearwardly of the central rollers 22*a*, 222*b* relative to the front of the chair 1.

Figure 18B:
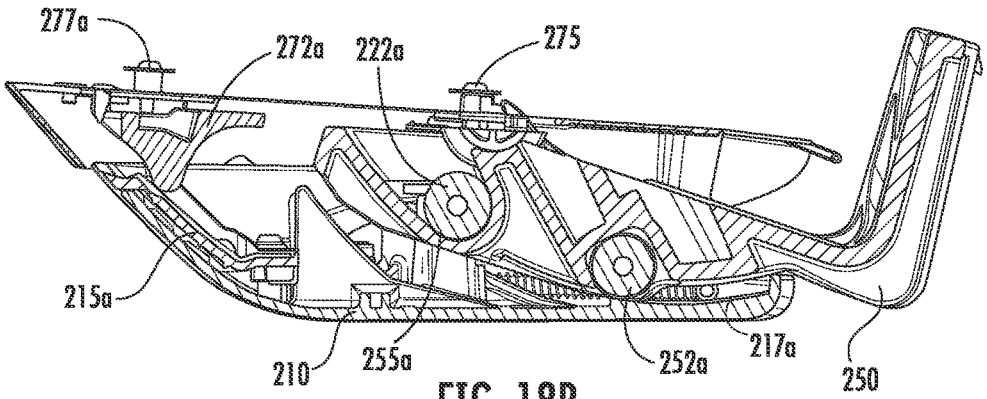
FIG. 18B is a right-side sectional view of the chair depicted in FIG. 1 in the reclined state.

In the reclined state depicted in FIG. 18B, the vertical extension of the connector 251 is pushed rearwards, causing the horizontal extension of the connector 251 to be pushed forward relative to the housing 211. As the horizontal extension of the connector 251 moves forward, the plurality of motion-facilitating components positioned within the seat assembly 200 move along the plurality of corresponding ramps. In the fully reclined state, the front, central and rear ramp assemblies are in the following states: the right and left front glides 272*a*, 272*b* are positioned at the front (or top) portions of the right and left front housing ramps 215*a*, 215*b*, respectively; the central rollers 222*a*, 222*b* are positioned on the rear portions of the right and left arcuate connector ramps 255*a*, 255*b*, respectively; and the rear rollers 252*a*, 252*b* are positioned on the front portions of the right and left rear housing ramps 217*a*, 217*b*, respectively. Through the interaction of the rollers and ramps of each of the front, central, and rear ramp assemblies, the seat plate subassembly 270 (and therefore the attached seat 290) is pushed forward and upwards relative to the housing 211.

The recline geometry and the ramp angles are optimized to minimize the vertical drop of the backrest during the recline motion, which in turn minimizes the seat lift during the recline motion. As shown in FIG. 19B, the virtual pivot 400 is projected above the seating surface and is defined by the intersection of imaginary lines extending in a perpendicular fashion from the rear housing ramps 217*a*, 217*b* and the connector ramps 255*a*, 255*b*. Point 405 represents the positioning of a typical user's hip joints when the seating apparatus 1 is in the upright position. Arc 415 represents the path the rearward movement of the backrest 310 during recline, with the left side of the arc 415 representing the position of the backrest 310 in the upright position and the right side of the arc 415 representing the position of the backrest 310 in the reclined position. Point 410 represents the hip pivot point of the thigh at full reline, and point 412 represents the hip pivot point of the back at full recline. It is preferable that the ramp angles and chair geometry are optimized to provide for points 410 and 412 to remain as close together as possible during a recline action in order to make the reclining action of the seating apparatus 1 have a more natural feel and avoid the common shirt-pull problem associated with many reclinable chairs. Moreover, by optimizing the recline geometry and the shape and angle of the ramps, a fully weight-sensitive seating apparatus can be provided that closely mimics the user's natural hip joint articulation during recline.

Figure 19A:
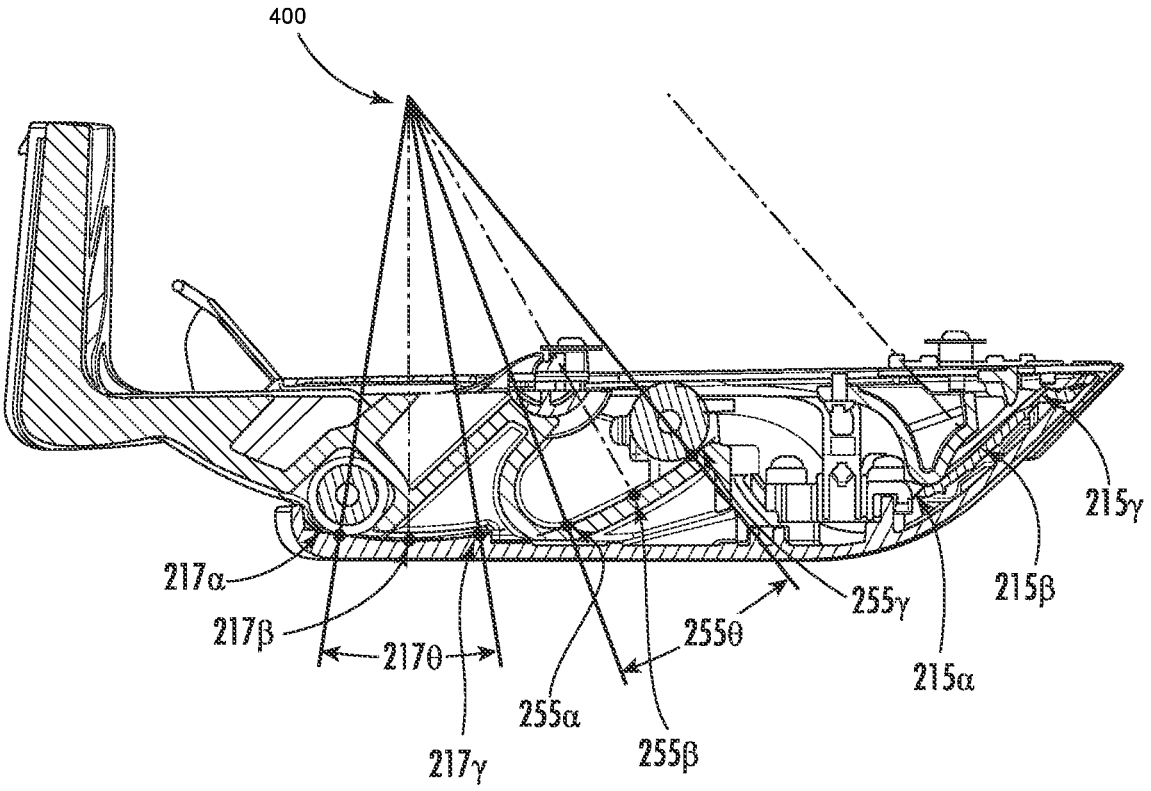
FIG. 19A is a left-side sectional view of the chair depicted in FIG. 1 in the upright state.
Figure 19B:
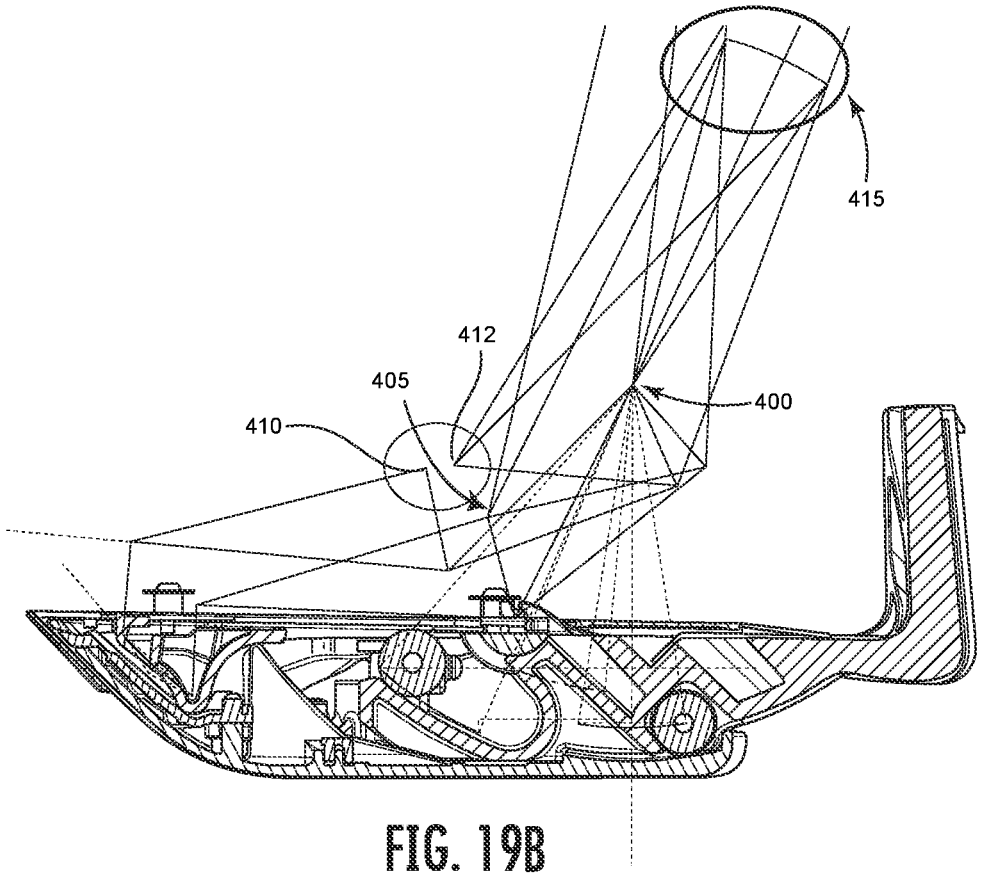
FIG. 19B is a right-side sectional view of the chair depicted in FIG. 1, showing a comparison of a typical user's body positioning in the chair when in the upright versus reclined states.

A preferred embodiment of the seating apparatus 1 is depicted in FIGS. 19A-19B. In the depicted embodiment, the right and left rear housing ramps 217*a*, 217*b* generally have a rocker-shaped (i.e., reverse camber) side profile, with the ramp angle gradually decreasing from the rear portion of the ramps 217*a*, 217*b* to the center of the ramp, and the ramp angle gradually increasing from the center of the ramp to the front portion of the ramps 217*a*, 217*b*. The connector ramps 255*a*, 255*b* generally have a J-shaped side profile, with the ramp angle gradually increasing from the rear portion of the ramps 255*a*, 255*b* to the front portion of the ramps 255*a*, 255*b*.

The rear housing ramps 217*a*, 217*b* and the connector ramps 255*a*, 255*b* collectively function to provide the virtual pivot 400 for the backrest assembly 300. The positioning of the virtual pivot 400 is dictated by the ramp angles of the rear housing ramps 217*a*, 217*b* and the connector ramps 255*a*, 255*b*. Specifically, the virtual pivot 400 is projected above the seating surface and its location is defined by the intersection of imaginary lines extending in a perpendicular (i.e., 90°) fashion from the rear housing ramps 217*a*, 217*b* and the connector ramps 255*a*, 255*b*. In the depicted embodiment, the rear housing ramps 217*a*, 217*b* and the connector ramps 255*a*, 255*b* have lengths and ramp angles optimized to provide a virtual pivot point 400 positioned above the seat 290 and forward of the backrest 310. In this manner, the chair 1's reclining mechanism in preferred embodiments will function to minimize both the vertical drop of the backrest and the lifting of the seat during the recline motion, thereby providing seating apparatus that relies on the user's weight for a vast majority of the recline resistance force (i.e., greater than 80% of the recline resistance force) while also maintaining the most ergonomic relationship as possible between the seat and the backrest throughout its range of motion.

In the embodiment depicted in FIGS. 19A and 19B, the width of the housing 211 is approximately 235 mm, the length of the housing 211 is approximately 315 mm, and the depth of the housing 211 is approximately 75 mm. The distance between the central rollers 222*a*, 222*b* and the rear rollers 252*a*, 252*b* is approximately 125 mm, and the central rollers 222*a*, 222*b* are positioned approximately 50 mm above the bottom floor of the housing 211 as measured from the central axis of the central rollers 222*a*, 222*b*. The roller axle diameters for both the central and rear rollers is approximately 9 mm, while the rollers themselves have diameters of approximately 30 mm. As measured from the horizontal plane, the rear ends of the rear housing ramps 217*a*, 217*b* exhibit a ramp angle 217α of approximately −9°; the center of the rear housing ramps 217*a*, 217*b* exhibit a ramp angle 2173 of approximately 0.0°; and the front ends of the rear housing ramps 217*a*, 217*b* exhibit a ramp angle 2177 of approximately +9°. As measured from the horizontal plane, the rear ends of the connector ramps 255*a*, 255*b* exhibit a ramp angle 255α of approximately 20°; the center of the connector ramps 255*a*, 255*b* exhibit a ramp angle 255β of approximately 29°; and the front ends of the connector ramps 255*a*, 255*b* exhibit a ramp angle 255γ of approximately 38°. The range of movement 217θ for the rear housing ramps 217*a*, 217*b* and the range of movement 255θ for the connector ramps 255*a*, 255*b* each are approximately 180 in the depicted embodiment. In alternative embodiments, the range of movement 255θ for the connector ramps 255*a*, 255*b* may range from approximately 150 to 250 in alternatives. In the depicted embodiment, the virtual pivot 400 is projected 120 mm above the seat surface 290 and 35 mm forward of the backrest 310. The median user's hip joint 405 is located approximately 60 mm above the seat surface 290 and approximately 100 mm forward of the backrest 310, which positions the median's user hip joint 405 approximately 50 mm behind the column 120. The seating apparatus preferably exhibits a front seat lift of approximately 1"±0.25" and a rearward seat pitch of approximately 1-3 degrees between the upright position and the fully reclined position. In alternative embodiments, the angles of the central connector ramps and rear housing ramps may be modified such that the virtual pivot 400 is projected 120 mm±20 mm above the seat surface and 20 mm±20 mm forward of the backrest, which is approximately 50-70 mm above and 60-80 mm behind the median user's hip joint 405.

The front housing ramps 215*a*, 215*b* function to control the lifting of the front portion—and thus the tilt—of the seat plate subassembly 270 during recline. Preferably, in the fully reclined state, the front portion of the seat plate subassembly 270 is lifted slightly higher than the rear portion of the seat plate subassembly 270. In the depicted embodiment, the front housing ramps 215*a*, 215*b* generally have a sloped side profile, with the ramp angle gradually increasing from the rear portion of the ramps 215*a*, 215*b* to the front portion of the ramps 255*a*, 255*b*. In the embodiment depicted in FIGS. 19A and 19B, and as measured from the horizontal plane, the rear ends of the front housing ramps 215*a*, 215*b*, exhibit a ramp angle 215α of approximately 33°; the center of the front housing ramps 215*a*, 215*b* exhibit a ramp angle 215β of approximately 41°; and the front ends of the front housing ramps 215*a*, 215*b* exhibit a ramp angle 215γ of approximately 49°.

In alternative embodiments, the ramp angles can vary according to various factors, including the sizing of the various components, the recline geometry, and the resistance provided by the friction introduced by the interaction of the motion facilitating components and the ramps. Because the load (i.e., the force) being applied against the backrest increases as the angle of the recline increases, the ramp angles of the rear housing ramps 217, connector ramps 255, and front housing ramps 215 preferably will vary across its length. The shape of the ramps and the motion-facilitating components may also vary. In certain embodiments, the ramps may by substantially linear in shape and the motion-facilitating components be non-uniform in shape. For example, the motion-facilitating components may take the form of substantially oval-shaped rollers. In so further embodiment, the rollers may be spherical, but the ramps may have varying shapes (e.g., partially linear and partial curved), thereby allowing varying lift motions. The motion-facilitating component may take on a variety of forms. For example, the component could be in the form of a roller shaped like a wheel. In one preferred embodiment, the rollers are spherical in nature. Such an embodiment is particularly beneficial for providing stability to the apparatus. The spherical shape increases the surface area of the roller in contact with the ramp, particularly when the ramp comprises a track having a concave shape (e.g., a valley running in the direction of travel) corresponding to the spherical rollers, thereby being particularly adapted for receiving the rollers. Accordingly, the roller becomes self-centering in the track and avoids drifts. Of course, other embodiments of the motion-facilitating components are also encompassed by the invention. For example, the motion-facilitating components could include stationary low-friction glides or ball bearings.

The rollers can be formed from metal or polymeric materials. In certain embodiments, the rollers are formed of low friction, high strength polymeric material, such as polytetrafluoroethylene (PTFE). In further embodiments, the rollers comprise elastomeric materials, such as urethanes, which soften the action of the rolling movement across the ramps, thereby providing a smooth action. The ramps are similarly preferably formed of a material providing strength, durability, and, preferentially, reduced friction during interaction with the rollers. Exemplary materials for use in the ramps include, but are not limited to, high density polyethylene, high density polypropylene, PTFE, and the like.

Many modifications and other embodiments of the inventions set forth herein will come to mind to one skilled in the art to which these inventions pertain having the benefit of the teaching presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A reclinable seating apparatus, comprising:

a seat assembly comprising a seat housing and a seat plate;

a backrest recline mechanism comprising: a connector having a horizontal extension and a vertical extension; a central ramp assemblage for operatively coupling the horizontal extension of the connector to a central portion of the seat housing; a rear ramp assemblage for operatively coupling the horizontal extension of the connector to a rear portion of the seat housing; and a front ramp assemblage for operatively coupling a front portion of the seat plate to a front portion of the seat housing; wherein the rear ramp assemblage comprises one or more rear housing ramps positioned on a rear portion of the seat housing; and one or more rear rollers attached to a bottom portion of the horizontal extension of the connector, wherein the one or more rear rollers operatively engage the one or more rear housing ramps; and a backrest assembly attached to the vertical extension of the connector.

2. The reclinable seating apparatus of claim 1, wherein the central ramp assemblage comprises: one or more connector ramps positioned on a front portion of the horizontal extension of the connector; and one or more central rollers attached to a central post extending vertically from a floor of the seat housing, wherein the one or more central rollers operatively engage the one or more connector ramps.

3. The reclinable seating apparatus of claim 2, wherein the one or more rear housing ramps each have a reverse camber side profile and a ramp gradient defining a rear ramp angle, wherein the rear ramp angle gradually decreases from a rear end of each rear housing ramp to a center of each rear housing ramp, and wherein the rear ramp angle gradually increases from the center of each rear housing ramp to a front end of each rear housing ramp.

4. The reclinable seating apparatus of claim 3, wherein the rear ramp angle of the one or more rear housing ramps varies from approximately −9° at the rear end of the one or more rear housing ramps to approximately +9° at the front end of the one or more rear housing ramps.

5. The reclinable seating apparatus of claim 2, wherein the one or more connector ramps each have a J-shaped side profile and a ramp gradient defining a connector ramp angle, wherein the connector ramp angle gradually increases from a rear end of each ramp to a front end of each ramp.

6. The reclinable seating apparatus of claim 5, wherein the connector ramp angle of the one or more connector ramps progressively increases from approximately +20° at the rear end of the one or more connector ramps to +38° at the front end of the one or more connector ramps.

7. The reclinable seating apparatus of claim 5, wherein a rear portion of the seat plate is pivotally attached to the connector.

8. The reclinable seating apparatus of claim 1, wherein the front ramp assemblage comprises one or more front housing ramps engaged by one or more front rollers, wherein the one or more front housing ramps are positioned on the front portion of the housing, and wherein the one or more front rollers are attached to a bottom surface of the seat plate.

9. A reclinable seating apparatus, comprising:

(a) a seat assembly comprising a housing; a L-shaped connector; a seat plate; and a plurality of ramp assemblages for operatively coupling both the L-shaped connector and the seat plate to the housing, wherein the plurality of ramp assemblages comprise: a front ramp assemblage for operatively coupling a front portion of the seat plate to a front portion of the housing; a central ramp assemblage for operatively coupling a front portion of the L-shaped connector to a central portion of the housing; and a rear ramp assemblage for operatively coupling a bottom portion of the L-shaped connector to a rear portion of the housing; wherein the rear ramp assemblage comprises: one or more rear housing ramps positioned on the rear portion of the housing; and one or more rear rollers attached to the bottom portion of the L-shaped connector, wherein the one or more rear rollers operatively engage the one or more rear housing ramps; and (b) a backrest assembly attached to the L-shaped connector.

10. The reclinable seating apparatus of claim 9, wherein the central ramp assemblage comprises: one or more connector ramps positioned on the front portion of the L-shaped connector; and one or more central rollers attached to a central post extending vertically from a floor of the housing, wherein the one or more central rollers operatively engage the one or more connector ramps.

11. The reclinable seating apparatus of claim 10, wherein the one or more rear housing ramps each have a rocker-shaped side profile and a ramp gradient defining a rear ramp angle, wherein the rear ramp angle gradually decreases from a rear end of each rear housing ramp to a center of each rear housing ramp, and wherein the rear ramp angle gradually increases from the center of each rear housing ramp to a front end of each rear housing ramp.

12. The reclinable seating apparatus of claim 10, wherein the one or more connector ramps each have a J-shaped side profile and a ramp gradient defining a connector ramp angle, wherein the connector ramp angle gradually increases from a rear end of each ramp to a front end of each ramp.

13. A reclinable seating apparatus, comprising:

(a) a base assembly;

(b) a seat assembly mounted to the base assembly, the seat assembly comprising:

i. a housing subassembly comprising a housing; a front housing ramp positioned in a front portion of the housing; a central motion-facilitating component positioned in a central portion of the housing; and a rear housing ramp positioned in a rear portion of the housing;

ii. a connector subassembly comprising a connector, the connector defining a vertical extension and a horizontal extension and wherein the horizontal extension of the connector comprises an arcuate connector ramp positioned in a front portion of the horizontal extension and a rear motion-facilitating component positioned in a rear portion of the horizontal extension, wherein the connector ramp is in operative engagement with the central motion facilitating component of the housing subassembly, and wherein the rear motion-facilitating component is in operative engagement with the rear housing ramp of the housing subassembly;

iii. a seat plate subassembly pivotally attached to the connector subassembly, the seat plate subassembly comprising a front motion-facilitating component engaged with the front housing ramp of the housing subassembly; and a backrest assembly attached to the vertical extension of the connector.

14. The reclinable seating apparatus of claim 13, wherein the rear housing ramp has a rocker-shaped side profile and a ramp gradient defining a rear ramp angle, wherein the rear ramp angle gradually decreases from a rear end of the rear housing ramp to a center of the rear housing ramp, and wherein the rear ramp angle gradually increases from the center of the rear housing ramp to a front end of the rear housing ramp.

15. The reclinable seating apparatus of claim 14, wherein the connector ramp has a J-shaped side profile and a ramp gradient defining a connector ramp angle, and wherein the connector ramp angle gradually increases from a rear end of the connector ramp to a front end of the connector ramp.

16. The reclinable seating apparatus of claim 13, wherein the seat plate subassembly further comprises a seat plate, a seat pivot attached to a rear portion of the seat plate, and the front motion-facilitating component attached to a front portion of the seat plate.

17. The reclinable seating apparatus of claim 16, wherein a first end of the seat pivot is attached to the rear portion of the seat plate and a second end of the seat pivot is pivotally attached to one or more finger extensions of the connector.

* * * * *